US009516902B1

(12) United States Patent
Adani et al.

(10) Patent No.: US 9,516,902 B1
(45) Date of Patent: Dec. 13, 2016

(54) SLEEP SACK

(71) Applicants: Nicole Esther Adani, Mill Valley, CA (US); Pamela Ann Meyers, San Francisco, CA (US)

(72) Inventors: Nicole Esther Adani, Mill Valley, CA (US); Pamela Ann Meyers, San Francisco, CA (US)

( * ) Notice: Subject to any disclaimer, the term of this patent is extended or adjusted under 35 U.S.C. 154(b) by 117 days.

(21) Appl. No.: 14/507,700

(22) Filed: Oct. 6, 2014

Related U.S. Application Data

(60) Provisional application No. 61/887,403, filed on Oct. 6, 2013.

(51) Int. Cl.
*A41B 13/06* (2006.01)

(52) U.S. Cl.
CPC ..... *A41B 13/06* (2013.01)

(58) Field of Classification Search
CPC ..... A41B 9/08; A41B 9/002; A41B 9/004; A41B 9/005; A41B 9/008; A41B 13/06
USPC ..... 2/144, 111, 83, 69, 108, 69.5
See application file for complete search history.

(56) References Cited

U.S. PATENT DOCUMENTS 2,307,266 A * 1/1943 Hansen ..... A41B 13/06 2/114
2,515,082 A * 7/1950 Evans ..... A41D 1/22 2/70
3,116,491 A * 1/1964 Previdi ..... A41D 1/20 2/102
4,158,892 A * 6/1979 Gonzales ..... A41D 10/00 2/69.5
4,532,654 A * 8/1985 Sigismonde ..... A41D 13/00 2/69.5
5,592,691 A * 1/1997 Ronald ..... A41D 15/00 2/243.1
5,628,064 A * 5/1997 Chung ..... A41D 15/00 2/119
8,245,322 B1 * 8/2012 Bouza ..... A41D 13/0012 2/102
9,003,564 B2 * 4/2015 Wynh ..... A41B 13/06 2/80

* cited by examiner

*Primary Examiner* — Anna Kinsaul
*Assistant Examiner* — Timothy K Trieu
(74) *Attorney, Agent, or Firm* — Plager Schack LLP

(57) ABSTRACT

A sleep sack is configured to be accessible. The sleep sack includes an upper portion detachably coupled to a lower portion with a longitudinal zipper. A latitudinal zipper is attached around the lower portion. The lower portion is sealed on all but one side when the latitudinal zipper is zipped.

3 Claims, 3 Drawing Sheets

SLEEP SACK

RELATED APPLICATION

This application claims priority to provisional patent application U.S. Ser. No. 61/887,403 filed on Oct. 6, 2013, the entire contents of which is herein incorporated by reference.

BACKGROUND

The embodiments herein relate generally to bedding and personal accessories.

Prior to embodiments of the disclosed invention, insulated sleep sacks were designed as a single purpose wearable blanket with a fixed length, therefore, they had a short life span of, on average, three to nine months. Babies and toddlers frequently soiled their sleep sacks by spitting up, having runny noses or diaper leaks. Once even a small area of the sleep-sack was soiled the whole sleep sack needed to be washed and dried. The frequent care required with insulated sleep sacks was inconvenient due to size and compatibility with most home washers and dryers, as well as due to the length of the washing process. The consumer needed several sleep sacks for continued use as well as for different seasons and climates. Embodiments of the disclosed invention solve these problems.

SUMMARY

A sleep sack is configured to be accessible. The sleep sack includes an upper portion detachably coupled to a lower portion with a longitudinal zipper. A latitudinal zipper is attached around the lower portion. The lower portion is sealed on all but one side when the latitudinal zipper is zipped.

In some embodiments, the upper portion can further include a first arm first partial opening joined to a first shoulder front covering. A front neck opening can be joined to the first shoulder front covering. A second shoulder front covering can be joined to the front neck opening joined. A second arm opening can be joined to the second shoulder front covering. A second shoulder rear covering can be joined to the second arm opening. A rear neck opening can be joined to the second shoulder rear covering. A first shoulder rear covering can be joined to the rear neck opening. A first arm second partial opening can be joined to the first shoulder rear covering. A first arm first partial opening can be joined to the first arm second partial opening and forming a first arm second partial opening fastener shrinks the first arm opening. A second torso covering can be joined to the first arm first partial opening. A lower distal portion can be joined to the second torso covering. A first torso covering can be joined to the lower distal portion and further joined to the first arm first partial opening.

In some embodiments, a first arm first partial opening fastener can be mechanically coupled to the first arm first partial opening. A second arm opening first fastener and a second arm opening second fastener can be mechanically coupled to the second arm opening. A first arm second partial opening fastener can be mechanically coupled to a first arm second partial opening. Joining the first arm first partial opening fastener to the first arm second partial opening fastener can shrink the first arm opening to better accommodate a smaller occupant. Joining the second arm opening first fastener to the second arm opening second fastener shrinks the second arm opening to better accommodate the smaller occupant.

In some embodiments, a first torso upper fastener and a second torso lower fastener can be mechanically coupled to the upper portion proximate the first torso covering. A third torso upper fastener and a fourth torso lower fastener can be mechanically coupled to the upper portion proximate the second torso covering. Joining the first torso upper fastener to the third torso upper fastener and joining the second torso lower fastener to the fourth torso lower fastener can fasten the first torso covering to the second torso covering.

In some embodiments, the first torso upper fastener and the third torso upper fastener can be located a first torso offset distance from the lower distal portion. Likewise, the second torso upper fastener and the fourth torso lower fastener can be located a second torso offset distance from the lower distal portion.

In some embodiments, a first shoulder front covering outer lower fastener, a first shoulder second shoulder front covering inner lower fastener, a first shoulder front covering outer upper fastener and a first shoulder front covering inner upper fastener can be mechanically coupled to the first shoulder front covering. A second shoulder front covering outer lower fastener, a second shoulder front covering inner lower fastener, a second shoulder front covering outer upper fastener and a second shoulder front covering inner upper fastener can be mechanically coupled to the second shoulder front covering. A first mode of operation can exist where the first shoulder front covering outer lower fastener can be connected to the second shoulder rear covering outer fastener; the first shoulder second shoulder front covering inner lower fastener can be connected to the second shoulder rear covering inner fastener; the second shoulder front covering inner lower fastener can be connected to the second shoulder rear covering inner fastener; and the second shoulder front covering outer lower fastener can be connected to the second shoulder rear covering outer fastener. A second mode of operation can exist where the first shoulder front covering outer upper fastener can be connected to the second shoulder rear covering outer fastener; the first shoulder front covering inner upper fastener can be connected to the second shoulder rear covering inner fastener; the second shoulder front covering inner upper fastener can be connected to the second shoulder rear covering inner fastener; the second shoulder front covering outer upper fastener can be connected to the second shoulder rear covering outer fastener.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
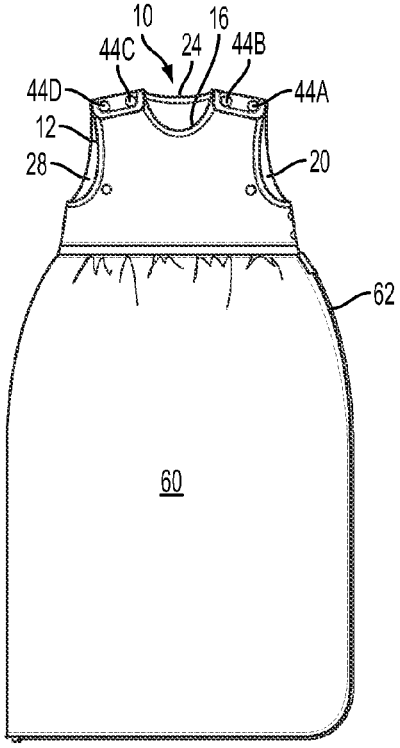
FIG. 1 shows a front view of an embodiment of the present invention.
Figure 2:
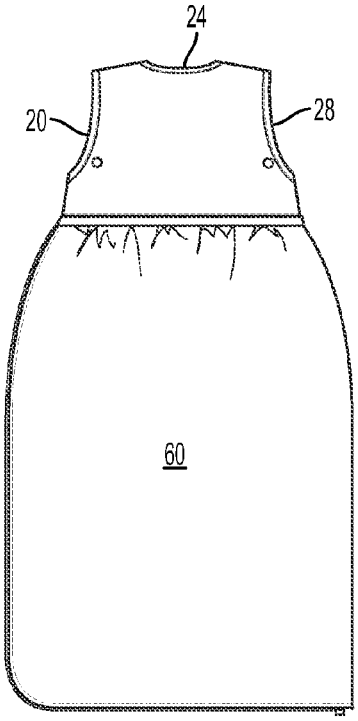
FIG. 2 shows a back view of an embodiment of the present invention.
Figure 3:
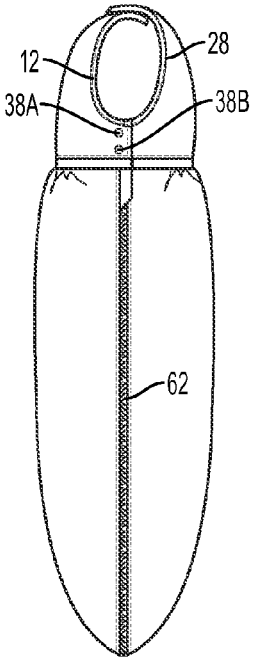
FIG. 3 shows a side view of an embodiment of the present invention.
Figure 4:
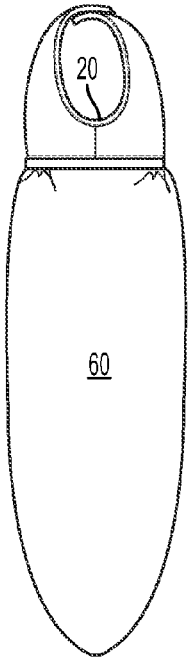
FIG. 4 shows a side view of an embodiment of the present invention.
Figure 5:
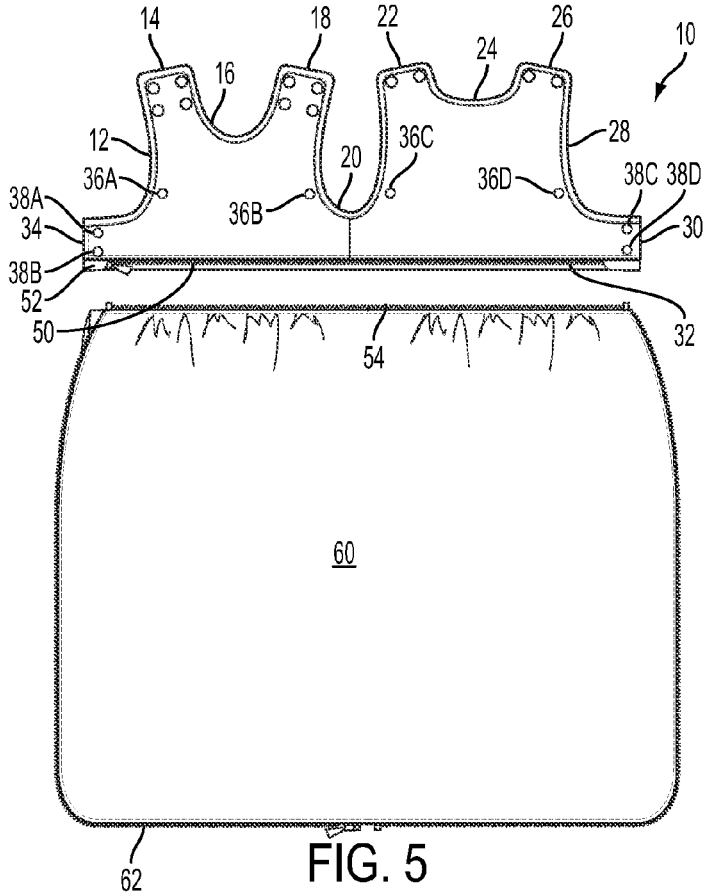
FIG. 5 shows an inside view of an embodiment of the present invention disassembled.
Figure 6:
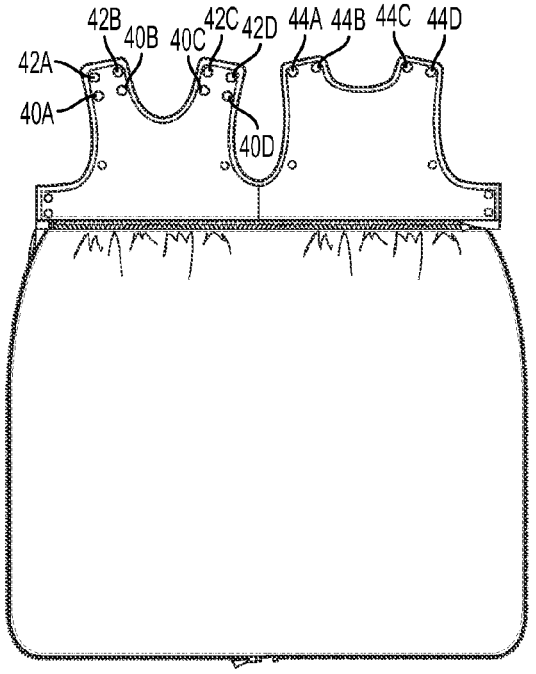
FIG. 6 shows an inside view of an embodiment of the present invention assembled.

By way of example, and referring to Figures one through seven, one embodiment of the sleep sack comprises upper portion 10 detachably coupled to lower portion 60. Upper portion 10 further comprises first arm first partial opening 12 which is joined first shoulder front covering 14. First shoulder front covering 14 is joined to front neck opening 16. Front neck opening 16 is joined to second shoulder front covering 18. Second shoulder front covering 18 is joined to second arm opening 20. Second arm opening 20 is joined to second shoulder rear covering 22. Second shoulder rear covering 22 is joined to rear neck opening 24. Rear neck opening 24 is joined to first shoulder rear covering 26. First shoulder rear covering 26 is joined to first arm second partial opening 28. First arm second partial opening 28 is joined with first arm first partial opening 12 to create a first arm opening. First arm second partial opening 28 is joined to second torso covering 30. Second torso covering 30 is joined to lower distal portion 32. Lower distal portion 32 is joined to first torso covering 34. First torso covering 34 is joined to first arm first partial opening 12.

The sleep sack uses a variety of fasteners that enable a plethora of uses for children ranging between six months and older. Upper portion 10 can have the first arm opening and second arm opening 20 adjusted to accommodate a human user less than a year old. First arm first partial opening 12 is mechanically coupled to first arm first partial opening fastener 36A. Second arm opening 20 is mechanically coupled to second arm opening first fastener 36B and a second arm opening second fastener 36C. First arm second partial opening 28 is mechanically coupled to first arm second partial opening fastener 36D. A user can join the first arm first partial opening fastener 36A to the first arm second partial opening fastener 36D shrink the first arm opening and better accommodate a smaller occupant. Likewise, a user can join the second arm opening first fastener 36B to the second arm opening second fastener 36C to shrink second arm opening 28 and better accommodate the smaller occupant. First arm first partial opening fastener 36A, second arm opening first fastener 36B, second arm opening second fastener 36C and first arm second partial opening fastener 36D are each located a first under arm distance from lower distal portion 32.

Upper portion 10 is mechanically coupled to first torso upper fastener 38A and second torso lower fastener 38B which are located proximate first torso covering 34. Upper portion 10 is further mechanically coupled to third torso upper fastener 38C and fourth torso lower fastener 38D which are located proximate second torso covering 30. First torso upper fastener 38A can be joined with third torso upper fastener 38C and second torso lower fastener 38B can be joined with fourth torso lower fastener 38D to securely fasten first torso covering 34 to second torso covering 30 around a human user. First torso upper fastener 38A and third torso upper fastener 38C are located a first torso offset distance from lower distal portion 32. Likewise, second torso upper fastener 38B and fourth torso lower fastener 38D are located a second torso offset distance from lower distal portion 32.

First shoulder front covering 14 is mechanically coupled to first shoulder front covering outer lower fastener 40A, first shoulder second shoulder front covering inner lower fastener 40B, first shoulder front covering outer upper fastener 42A and first shoulder front covering inner upper fastener 42B. Second shoulder front covering 18 is mechanically coupled to second shoulder front covering inner lower fastener 40C, second shoulder front covering outer lower fastener 40D, second shoulder front covering inner upper fastener 42C and second shoulder front covering outer upper fastener 42D. Second shoulder rear covering 22 is mechanically coupled to second shoulder rear covering outer fastener 44A and second shoulder rear covering inner fastener 44B. First shoulder rear covering 26 is mechanically coupled to second shoulder rear covering inner fastener 44C and second shoulder rear covering outer fastener 44D.

For children 12 to 24 months of age, a compact embodiment can be obtained by connecting first shoulder front covering outer lower fastener 40A to second shoulder rear covering outer fastener 44A. Next, connecting first shoulder second shoulder front covering inner lower fastener 40B to second shoulder rear covering inner fastener 44B. Then, connecting second shoulder front covering inner lower fastener 40C to second shoulder rear covering inner fastener 44C. After that, connecting second shoulder front covering outer lower fastener 40D to second shoulder rear covering outer fastener 44D.

For children 24 months of age and older, a larger embodiment can be obtained by connecting first shoulder front covering outer upper fastener 42A to second shoulder rear covering outer fastener 44A. Next, connecting first shoulder front covering inner upper fastener 42B to second shoulder rear covering inner fastener 44B. Then, connecting second shoulder front covering inner upper fastener 42C to second shoulder rear covering inner fastener 44C. After that, connecting second shoulder front covering outer upper fastener 42D to second shoulder rear covering outer fastener 44D.

Lower distal portion 32 is mechanically coupled to upper portion longitudinal zipper 50 and upper portion longitudinal zipper housing 52. Lower portion 60 is mechanically coupled to lower portion longitudinal zipper 54. A user can detachably couple upper portion longitudinal zipper housing 52 to lower portion longitudinal zipper 54 to join upper portion 10 to lower portion 60. As shown in FIG. 1, Lower portion 60 further comprises three open sides a bottom side, a vertical side and a top side. Latitudinal zipper 62 wraps around the bottom side and vertical side closing the bottom side and the vertical side while leaving the top side open.

Figure 10:
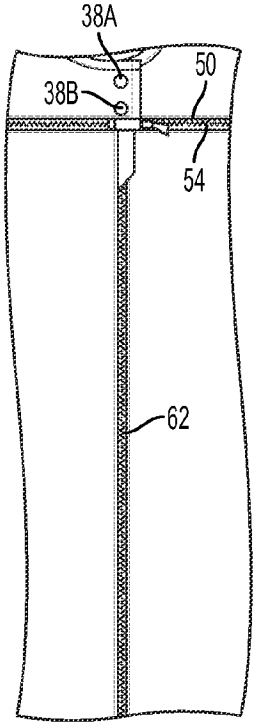
FIG. 10 shows a side view of a lower portion of the invention.
Figure 9:
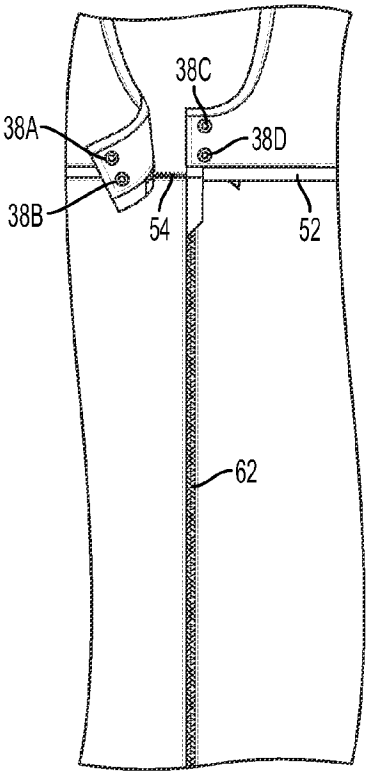
FIG. 9 shows a side view of a lower portion of the invention.
Figure 8:
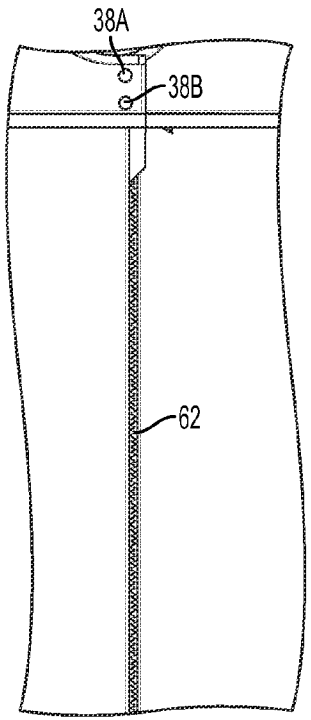
FIG. 8 shows a side view of a lower portion of the invention.
Figure 7:
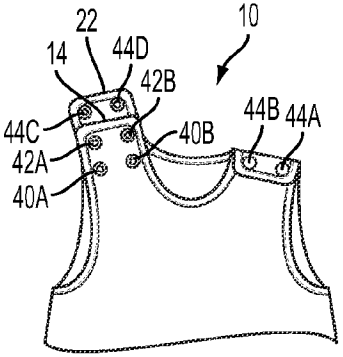
FIG. 7 shows a front view of an upper portion of the invention.

Turning to FIGS. 8 through 10, a user can fold both upper portion 10 and lower portion 60 in half. Lower portion 60 is mechanically coupled to latitudinal zipper 62, which is mechanically coupled to itself turning lower portion 62 into a pouch. This is useful in the event that an occupant needs a diaper change, there is no need to entirely disrobe the occupant, and rather latitudinal zipper 62 can simply be unzipped in order to provide access to the diaper. For children age 24 to 36 months, the bottom edge of lower portion 60 can be unzipped enabling an occupant's legs to extend through the bottom edge to encourage walking.

While "fastener" in this application is shown as a snap, in some embodiments the fastener may be a button, magnet or hook and loop fastener. Upper portion 10 and lower portion 60 can be made of a variety of materials using known material working techniques. However, two layers of 100% cotton with a supersoft finish filled with a synthetic microfiber thermal insulation material such as the one sold under the trademark PRIMALOFT® has been found to be effective for keeping the occupant warm.

In one mode of operation, a first upper portion 10 can be replaced by a second upper portion 10 in the event that the first upper portion 10 is soiled in some way. In another mode of operation, when lower portion 60 is unzipped it may be used as a blanket, security blanket or mat. The lower portion 60 can be taken with the child at a variety of ages.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A sleep sack, configured to be accessible; the sleep sack comprising: an upper portion detachably coupled to a lower portion with a longitudinal zipper; wherein the upper portion further comprises:

a first arm first partial opening, joined to a first shoulder front covering;

a front neck opening, joined to the first shoulder front covering;

a second shoulder front covering, joined to the front neck opening joined;

a second arm opening, joined to the second shoulder front covering;

a second shoulder rear covering, joined to the second arm opening;

a rear neck opening, joined to the second shoulder rear covering;

a first shoulder rear covering, joined to the rear neck opening;

a first arm second partial opening, joined to the first shoulder rear covering;

a first arm opening formed by the first arm first partial opening joined to the first arm second partial opening;

a second torso covering joined to the first arm first partial opening;

a lower distal portion of the upper portion joined to the second torso covering;

a first torso covering joined to the lower distal portion of the upper portion and further joined to the first arm first partial opening; wherein the lower portion further comprises three open sides: a bottom side opening, a vertical side opening and a top side opening;

a latitudinal zipper attached around the lower portion; wherein the latitudinal zipper wraps around the bottom side opening and vertical side opening for closing the bottom side opening and the vertical side opening while leaving the top side open when the latitudinal zipper is zipped;

a first shoulder front covering outer lower fastener, a first shoulder second shoulder front covering inner lower fastener, a first shoulder front covering outer upper fastener and a first shoulder front covering inner upper fastener are mechanically coupled to the first shoulder front covering; and a second shoulder front covering outer lower fastener, a second shoulder front covering inner lower fastener, a second shoulder front covering outer upper fastener and a second shoulder front covering inner upper fastener are mechanically coupled to the second shoulder front covering a first arm first partial opening fastener mechanically coupled to the first arm first partial opening;

a second arm opening first fastener and a second arm opening second fastener mechanically coupled to the second arm opening;

a first arm second partial opening fastener mechanically coupled to the first arm second partial opening;

wherein joining the first arm first partial opening fastener to the first arm second partial opening fastener is configured to shrink the first arm opening which is configured to better accommodate a smaller occupant;

wherein joining the second arm opening first fastener to the second arm opening second fastener to shrink the second arm opening which is configured to better accommodate the smaller occupant;

a first torso upper fastener and a second torso lower fastener mechanically coupled to the upper portion proximate the first torso covering;

a third torso upper fastener and a fourth torso lower fastener mechanically coupled to the upper portion proximate the second torso covering;

wherein joining the first torso upper fastener to the third torso upper fastener and joining the second torso lower fastener to the fourth torso lower fastener fastens the first torso covering to the second torso covering;

wherein the first torso upper fastener and the third torso upper fastener are located a first torso offset distance from the lower distal portion of the upper portion; and wherein the second torso lower fastener and the fourth torso lower fastener are located a second torso offset distance from the lower distal portion of the upper portion.

2. The sleep sack of claim 1, wherein a first mode of operation exists where the first shoulder front covering outer lower fastener is connected to the second shoulder rear covering outer fastener; the first shoulder second shoulder front covering inner lower fastener is connected to the first shoulder rear covering inner fastener; the second shoulder front covering inner lower fastener is connected to the second shoulder rear covering inner fastener; and the second shoulder front covering outer lower fastener is connected to the second shoulder rear covering outer fastener.

3. The sleep sack of claim 2, wherein a second mode of operation exists where the first shoulder front covering outer upper fastener is connected to the second shoulder rear covering outer fastener; the first shoulder front covering inner upper fastener is connected to the second shoulder rear covering inner fastener; the second shoulder front covering inner upper fastener is connected to the second shoulder rear covering inner fastener; the second shoulder front covering outer upper fastener is connected to the second shoulder rear covering outer fastener.

* * * * *